US007096808B2

(12) United States Patent
Chang

(10) Patent No.: US 7,096,808 B2
(45) Date of Patent: Aug. 29, 2006

(54) PROTECTION DEVICE FOR PREVENTING BROKEN NEEDLE OF SEWING MACHINE

(76) Inventor: Tseng Hsien Chang, 9F, No. 270, Gaogong Rd., South District, Taichung, 402 (TW)

( * ) Notice: Subject to any disclaimer, the term of this patent is extended or adjusted under 35 U.S.C. 154(b) by 0 days.

(21) Appl. No.: 11/196,315

(22) Filed: Aug. 4, 2005

(65) Prior Publication Data

US 2005/0268831 A1 Dec. 8, 2005

Related U.S. Application Data

(63) Continuation-in-part of application No. 10/837,659, filed on May 4, 2004, now abandoned.

(51) Int. Cl.
*D05B 83/00* (2006.01)
*D05B 29/00* (2006.01)

(52) U.S. Cl. ..... 112/261; 112/235

(58) Field of Classification Search ..... 112/261, 112/235, 236, 240, 227; D29/106, 107, 113, D29/122

See application file for complete search history.

(56) References Cited

U.S. PATENT DOCUMENTS

| | | | | | |
|---|---|---|---|---|---|
| 1,091,363 | A | * | 3/1914 | Martin | 112/261 |
| 1,211,340 | A | * | 1/1917 | Page | 112/261 |
| 1,324,736 | A | * | 12/1919 | Gardner | 112/261 |
| 1,468,934 | A | * | 9/1923 | Tyd | 112/261 |
| 1,959,138 | A | * | 5/1934 | Nimmer | 112/235 |
| 2,065,031 | A | * | 12/1936 | Sklar | 112/261 |
| 2,556,406 | A | * | 6/1951 | Wapner | 112/235 |
| 3,019,751 | A | * | 2/1962 | Fichera | 112/261 |
| 5,918,559 | A | * | 7/1999 | Sakino | 112/261 |

* cited by examiner

*Primary Examiner*—Ismael Izaguirre
(74) *Attorney, Agent, or Firm*—Rosenberg, Klein & Lee

(57) ABSTRACT

A protection device for sewing machine includes a presser which has a first end connected to a presser bar and a second end of the presser has a through hole so that the needle reciprocally extends therethrough. A needle cover is connected to a top of the second end of the presser and no gap is defined between the needle cover and the top of the presser. The needle cover protects the user from being hurt by broken needle.

9 Claims, 5 Drawing Sheets

PROTECTION DEVICE FOR PREVENTING BROKEN NEEDLE OF SEWING MACHINE

This is a Continuation-In-Part application of applicant's former patent application Ser. No. 10/837,659, filed on May 4, 2004 now abandoned.

BACKGROUND OF THE INVENTION

Field of the Invention

A conventional needle protection cover for sewing machine is shown in U.S. Pat. No. 5,918,559 which includes a needle cover removably connected to the needle bar so as to prevent the broken needle from hurting the user. It is noted that there is a gap defined between the presser and the needle cover so that the tip of the broken needle might fly through that gap and hurts the user. Especially when operating the sewing machine, the gap becomes larger than usual. Besides, the needle cover is a tubular member so that when the needle is broken, the user has to disengage the needle cover to remove and clean up the broken needle. U.S. Pat. Nos. 4,562,783 and 3,019,751 respectively disclose two needle covers connected to the presser bar and the body of the sewing machine. They have a common problem that a gap is defined between the needle cover and the presser so that the broken needle might fly out from that gap.

The present invention intends to provide a protection device for sewing machine wherein the needle cover is integrally connected to a top of the presser so that no gap is defined between the needle cover and the presser such that the broken needle can be stopped by the needle cover.

SUMMARY OF THE INVENTION

The present invention relates to a protection device for sewing machine and comprises a presser and a presser bar is connected to a first end of the presser, a second end of the presser has a through hole so that the needle reciprocally extends through the through hole when in use. A needle cover is connected to a top of the second end of the presser and no gap is defined between the needle cover and the top of the presser.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
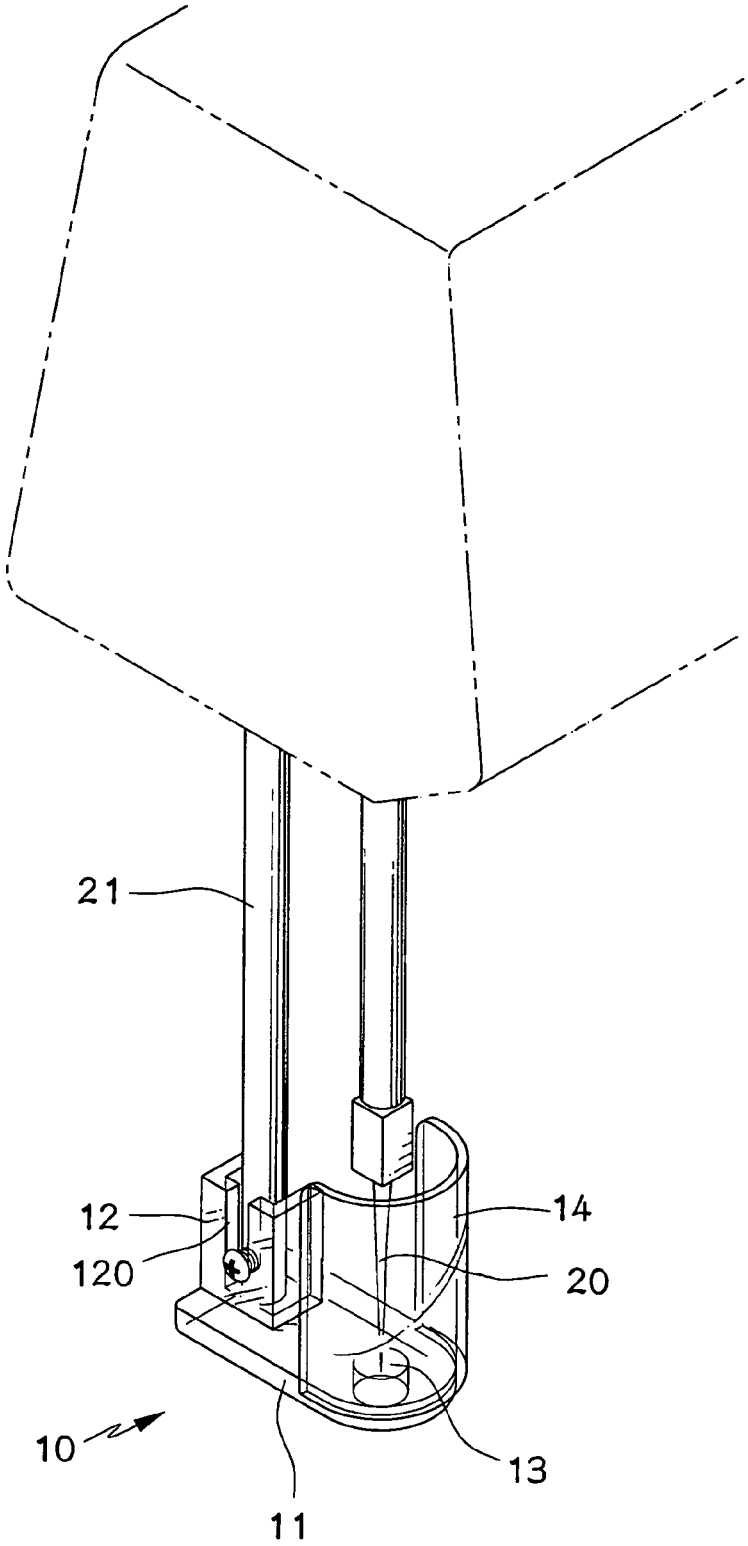
FIG. 1 is a perspective view of the protection device installed to a sewing machine.
Figure 2:
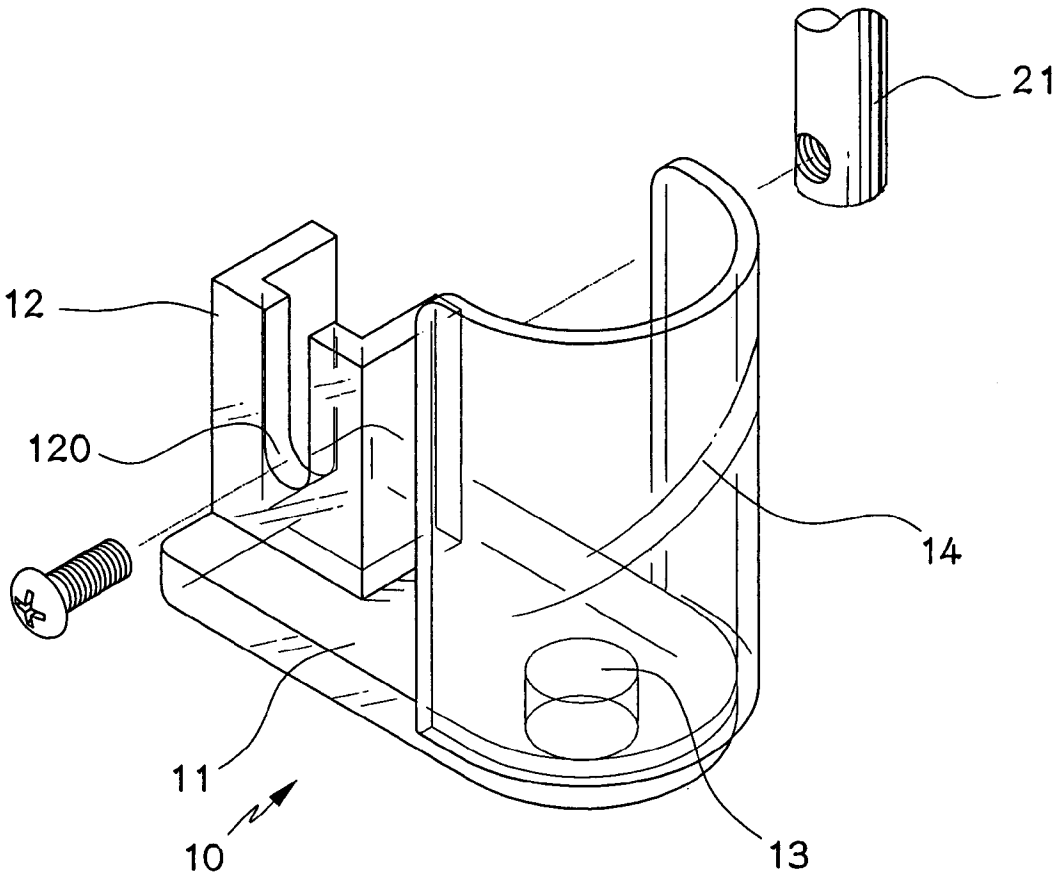
FIG. 2 is an exploded view to show the protection device and the presser bar.
Figure 3:
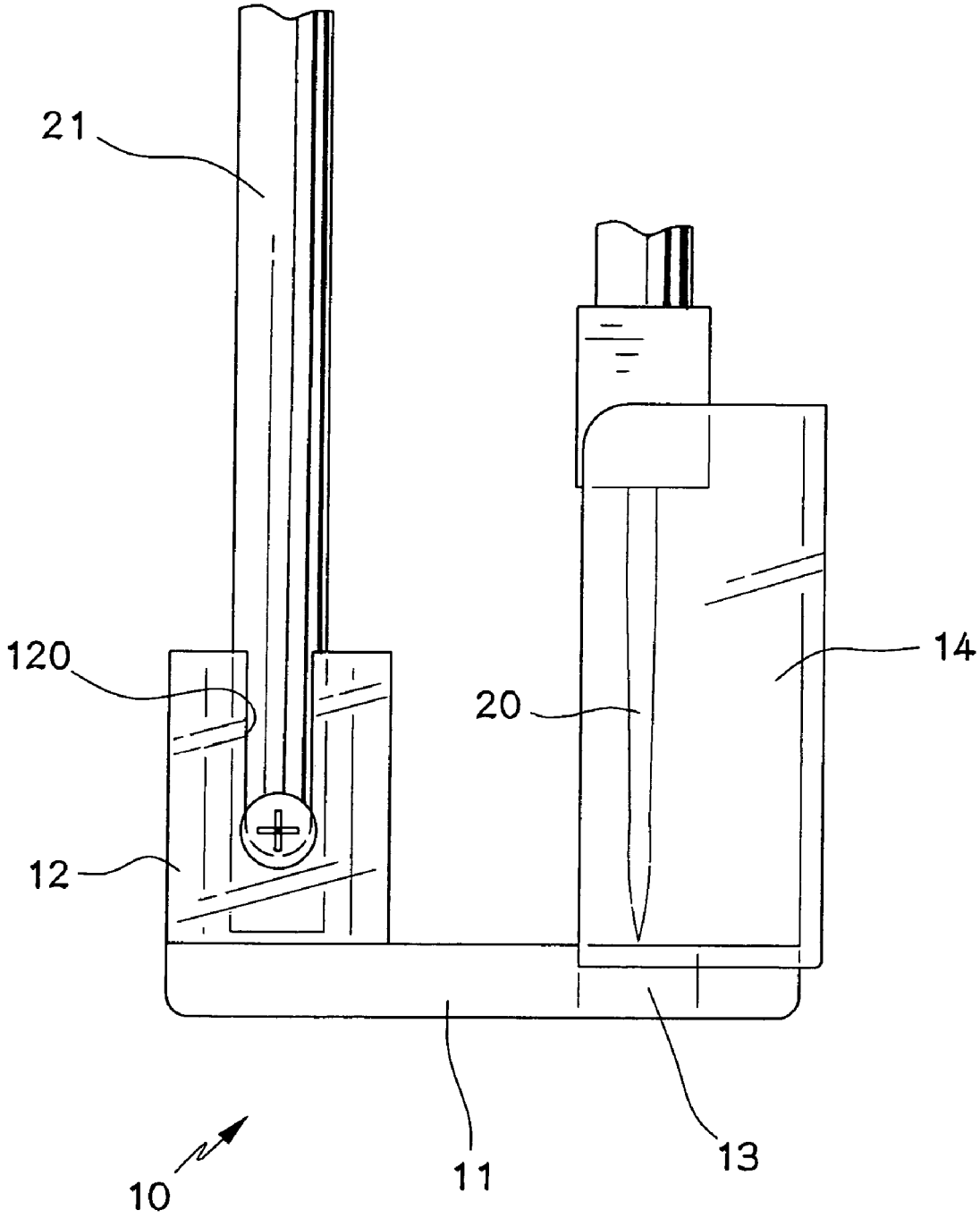
FIG. 3 is a side view to show the protection device installed to a sewing machine.

Referring to FIGS. 1 to 3, the protection device 10 of the present invention comprises a presser 11 and a connection member 12 is connected to a top of a first end of the presser 11. The connection member 12 has an open top and a longitudinal slot 120 is defined in a wall of the connection member 12. The longitudinal slot 120 communicates with the open top so that a lower end of a presser bar 21 is inserted into the connection member 12 via the open top. A positioning bolt extends through the longitudinal slot 120 and is threaded connected to a threaded hole in the presser bar 21. A second end of the presser 11 has a through hole 13 so that a needle 20 reciprocally extends through the through hole 13 when operating the sewing machine.

A needle cover 14 is integrally connected to a top of the second end of the presser 11 and no gap is defined between the needle cover 14 and the top of the presser 11. The needle cover 14 is high enough to cover the movement range of the needle 20. The needle cover 14 has a C-shaped cross section which is consistent along the longitudinal direction of the needle cover 14 and opens to the presser bar 21 so that if the needle 20 is broken, the broken needle 20 is stopped by the needle cover 14 and can be easily to clean up.

Figure 4:
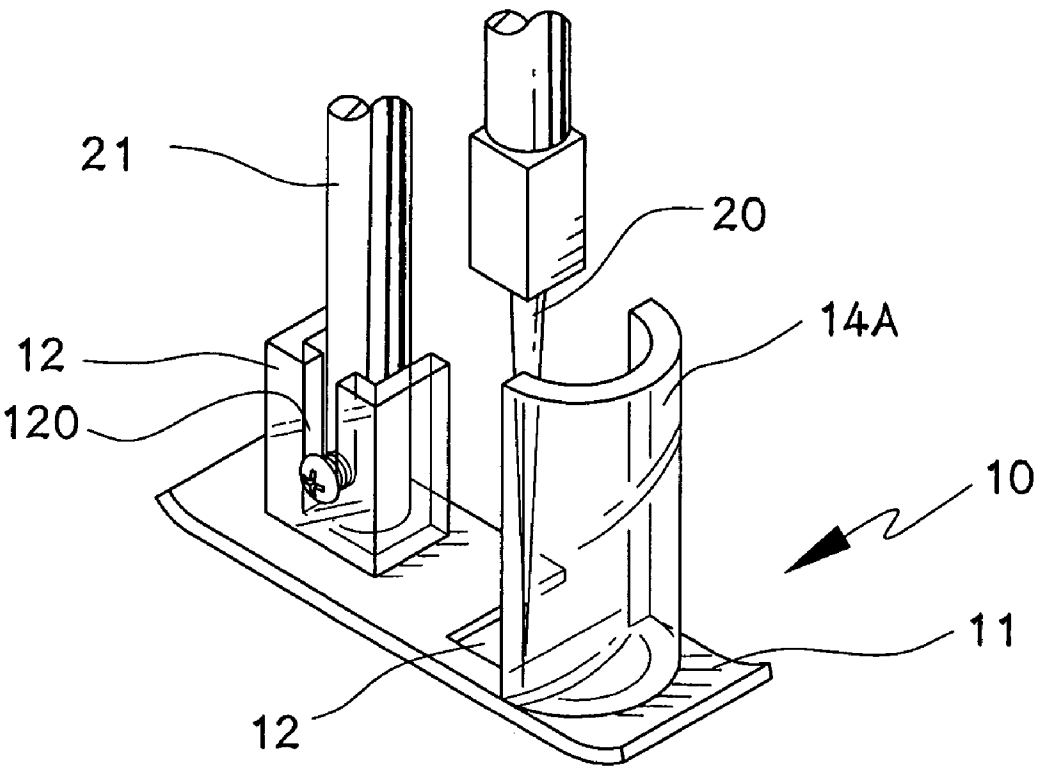
FIG. 4 shows another embodiment of the needle cover of the present invention.

FIG. 4 shows another embodiment of the protection device 10 wherein the presser 11 includes an upward second end and a notch 12 through which the needle 20 extends. The needle cover 14A is connected to the top of the second end of the presser 11.

Figure 5:
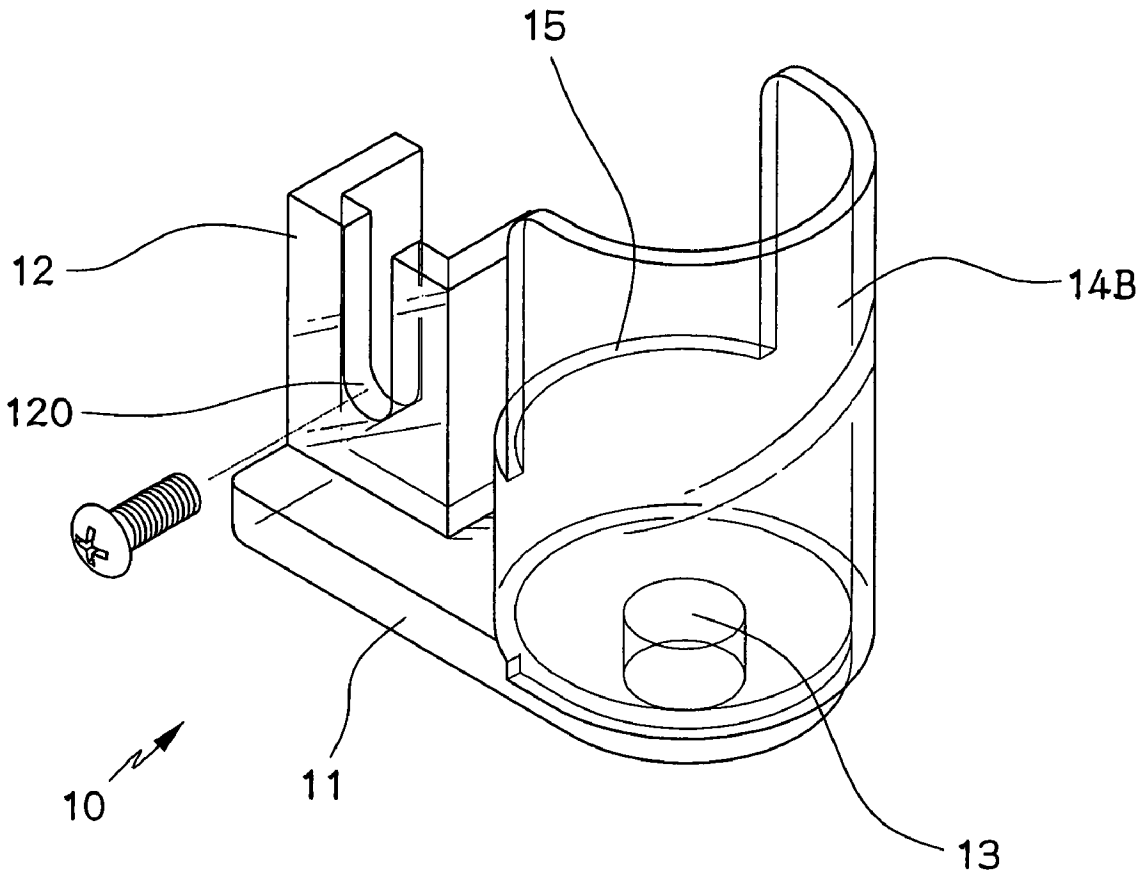
FIG. 5 shows yet another embodiment of the needle cover of the present invention.

FIG. 5 shows yet another embodiment of the protection device 10 wherein the needle cover 14B is a tubular member and includes an open top so that the needle 20 is inserted in the needle cover 14*b* via the open top. A recess 15 is defined longitudinally in the tubular needle cover 14B and communicates with the open top of the needle cover 14B. The recess 15 faces the presser bar 21 and forms a lower wall compared with the height of the tubular needle cover 14B such that the tubular needle cover 14B includes an enclosed section including the lower wall. The enclosed section directly contacts the top of the presser 11.

Because there is no gap defined between the presser 11 and the needle cover 14/14A/14B, the broken needle 20 cannot hurt the users. Besides, the needle cover has an open side facing the presser bar 21 so that the broken needle can be easily cleaned up.

While we have shown and described the embodiment in accordance with the present invention, it should be clear to those skilled in the art that further embodiments may be made without departing from the scope of the present invention.

What is claimed is:

1. A protection device for sewing machine, comprising:

a presser having a first end adapted to be connected to a presser bar and a needle cover connected to a top of a second end of the presser and no gap defined between the needle cover and the top of the presser, the needle cover being a tubular member and including an open top which is adapted to allow the needle to insert in the needle cover via the open top, a recess is defined longitudinally in the tubular needle cover so as to form a lower wall compared with a height of the tubular needle cover, the tubular needle cover including an enclosed section including the lower wall, the enclosed section directly contacting the top of the presser (11), the recess communicating with the open top of the needle cover and adapted to face the presser bar.

2. The device as claimed in claim 1, wherein a connection member has an open top and a longitudinal slot is defined in a wall of the connection member, the longitudinal slot communicates with the open top, the open top is adapted to receive a lower end of the presser bar and a positioning bolt extends through the longitudinal slot and is adapted to be connected to the presser bar.

3. The device as claimed in claim 1, wherein the needle cover has a C-shaped cross section which is adapted to open to the presser bar.

4. The device as claimed in claim 1, wherein the second end of the presser has a through hole which is adapted to allow a needle to reciprocally extend therethrough.

5. The device as claimed in claim 1, wherein the second end of the presser has a notch which is adapted to allow a needle to reciprocally extend therethrough.

6. A protection device for sewing machine, comprising:

a presser having a first end adapted to be connected to a presser bar and a needle cover connected to a top of a second end of the presser and no gap defined between the needle cover and the top of the presser, the needle cover having a C-shaped cross section which is consistent along the longitudinal direction of the needle cover (14) and adapted to open to the presser bar.

7. The device as claimed in claim 6, wherein a connection member has an open top and a longitudinal slot is defined in a wall of the connection member, the longitudinal slot communicates with the open top, the open top is adapted to receive a lower end of the presser bar and a positioning bolt extends through the longitudinal slot and is adapted to be connected to the presser bar.

8. The device as claimed in claim 6, wherein the second end of the presser has a through hole which is adapted to allow a needle to reciprocally extend therethrough.

9. The device as claimed in claim 6, wherein the second end of the presser has a notch which is adapted to allow a needle to reciprocally extend therethrough.

* * * * *